US006948330B2

(12) United States Patent
Renaud

(10) Patent No.: US 6,948,330 B2
(45) Date of Patent: Sep. 27, 2005

(54) CAGE FOR FROZEN FOODS WITH REDUCER OF COLD ROOM

(76) Inventor: Alain Renaud, 98, Langevin, Beauport (CA) G1B 5C5

( * ) Notice: Subject to any disclaimer, the term of this patent is extended or adjusted under 35 U.S.C. 154(b) by 113 days.

(21) Appl. No.: 10/379,523

(22) Filed: Mar. 6, 2003

(65) Prior Publication Data

US 2005/0178143 A1 Aug. 18, 2005

(51) Int. Cl.[7] ..... F25D 3/12; B65D 6/16
(52) U.S. Cl. ..... 62/383; 62/384; 220/4.31
(58) Field of Search ..... 62/383, 379, 457.2, 62/457.9, 480, 384, 371, 372; 220/4.31; 206/600

(56) References Cited

U.S. PATENT DOCUMENTS 2,692,177 A * 10/1954 Larsen ..... 312/71
6,227,397 B1 * 5/2001 Kim ..... 220/8
6,450,360 B1 * 9/2002 Hyde ..... 220/559

* cited by examiner

*Primary Examiner*—Chen Wen Jiang

(57) ABSTRACT

A cage in which is mounted a reducer of cold room that can be manually raised and blocked during the loading or unloading of the goods, and that automatically slopes down above the frozen foods when the door is closed for reducing the space preserving the frozen foods either by using the ice bags or dry ice during the delivery of the frozen foods.

3 Claims, 12 Drawing Sheets

CAGE FOR FROZEN FOODS WITH REDUCER OF COLD ROOM

BACKGROUND OF THE INVENTION

1. Field of the Invention

More particularly, this invention refers to a cage in which is mounted a reducer of cold room that automatically slopes down above the frozen foods when the door is closed for reducing the space preserving the frozen foods either by using the ice bags or dry ice during the delivery of the frozen foods.

2. Description of the Related Art

A search of prior art records has unveiled the following patents:

1. U.S. 2003/0014994 A1 registered in 2002 to Smith and al.;
2. U.S. Pat. No. 4,947,658 issued in 1990 to Wheeler and al.;
3. EP 0,7118,212 A1 issued in 1996 to Hazley and al.;
4. U.S. Pat. No. 4,407,144 issued in 1983 to Garside;
5. U.S. Pat. No. 4,682,708 issued in 1987 to Pool; and
6. U.S. Pat. No. 4,921,105 issued in 1990 to Culbreth.

The patents of Smith, Wheeler, Hazley, Garside, Pool and Culbreth are probably the most relevant.

In the current market the cages are known for the delivery of frozen foods, however the existing cages have a disadvantage: since the cages are not provided with a reducer of cold room, that requires to cool completely the cage when the space is very not used inside of the cage during the delivery of the frozen foods.

SUMMARY OF THE INVENTION

The present invention refers to a cage in which is mounted a reducer of cold room that can be manually raised and blocked during the loading or unloading of the frozen foods, and that automatically slopes down above the frozen foods when the door is closed for reducing the space preserving the frozen foods either by using the ice bags or dry ice during the delivery of the frozen foods.

The cage includes a plurality of tubular members in which are engaged each insulating panel, a pair of legs is mounted under each tubular member including a member with slide rail for receiving a pallet on which resting the frozen foods, a reinforcing bar is mounted in the center of each insulating panel for solidifying the structure of the cage, and a tubular member in which is engaged an insulating panel, is provided with the hinges for connecting a structure in which is engaged an insulating panel on which is mounted a reinforcing bar for solidifying the structure of the door.

BRIEF DESCRIPTION OF THE SEVERAL VIEWS OF THE DRAWING(S)

Having thus generally described the nature of the present invention, reference will now be made to the accompanying drawings, showing by way of illustration a preferred embodiment thereof and in which.

NUMERICAL REFERENCES OF THE ILLUSTRATED ELEMENTS

Figure 1:
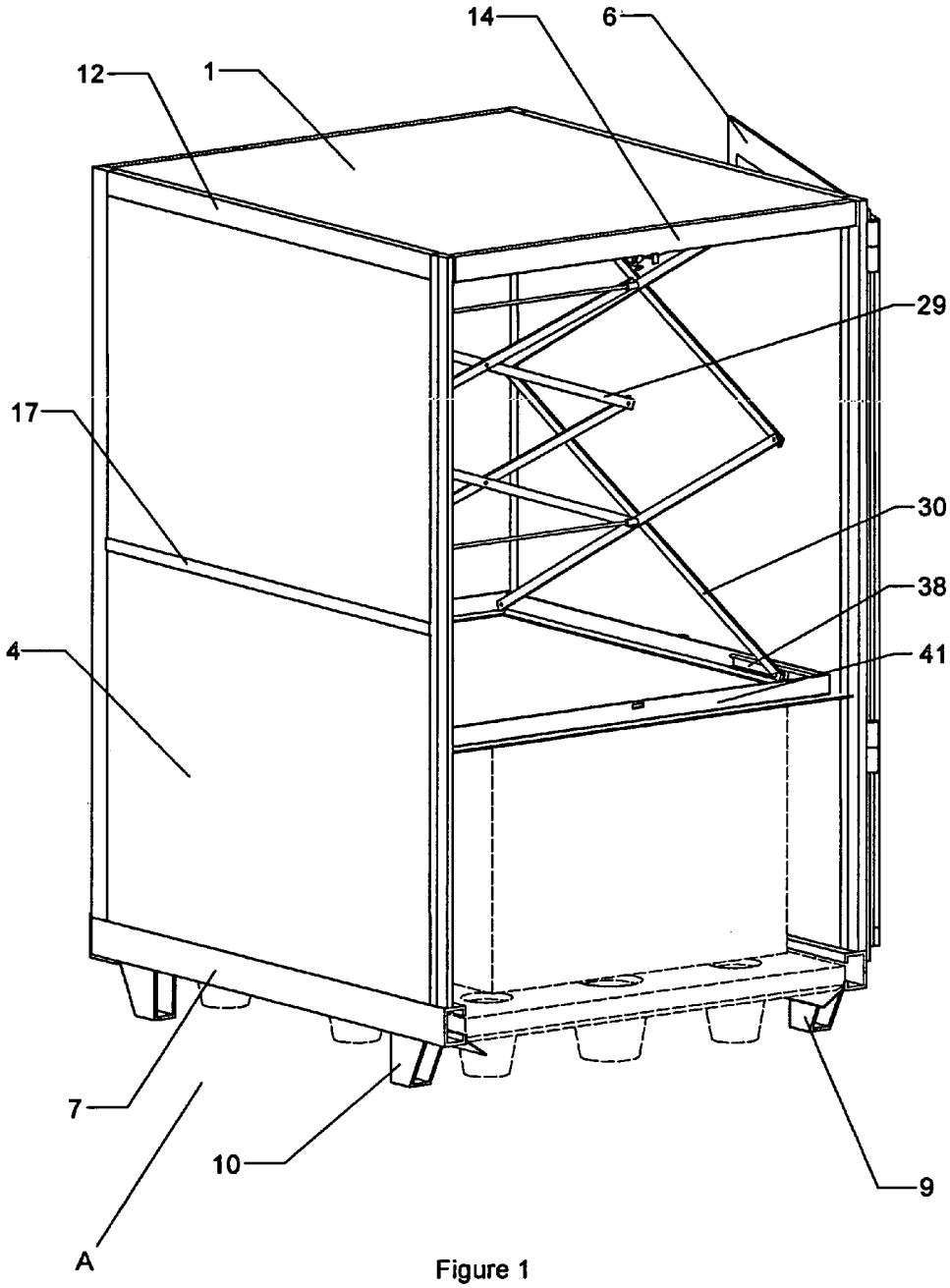
FIG. 1 is a perspective left side view of a cage for frozen foods showing a reducer of cold room lowered to the height of the frozen foods resting on a pallet engaged inside the cage.
Figure 2:
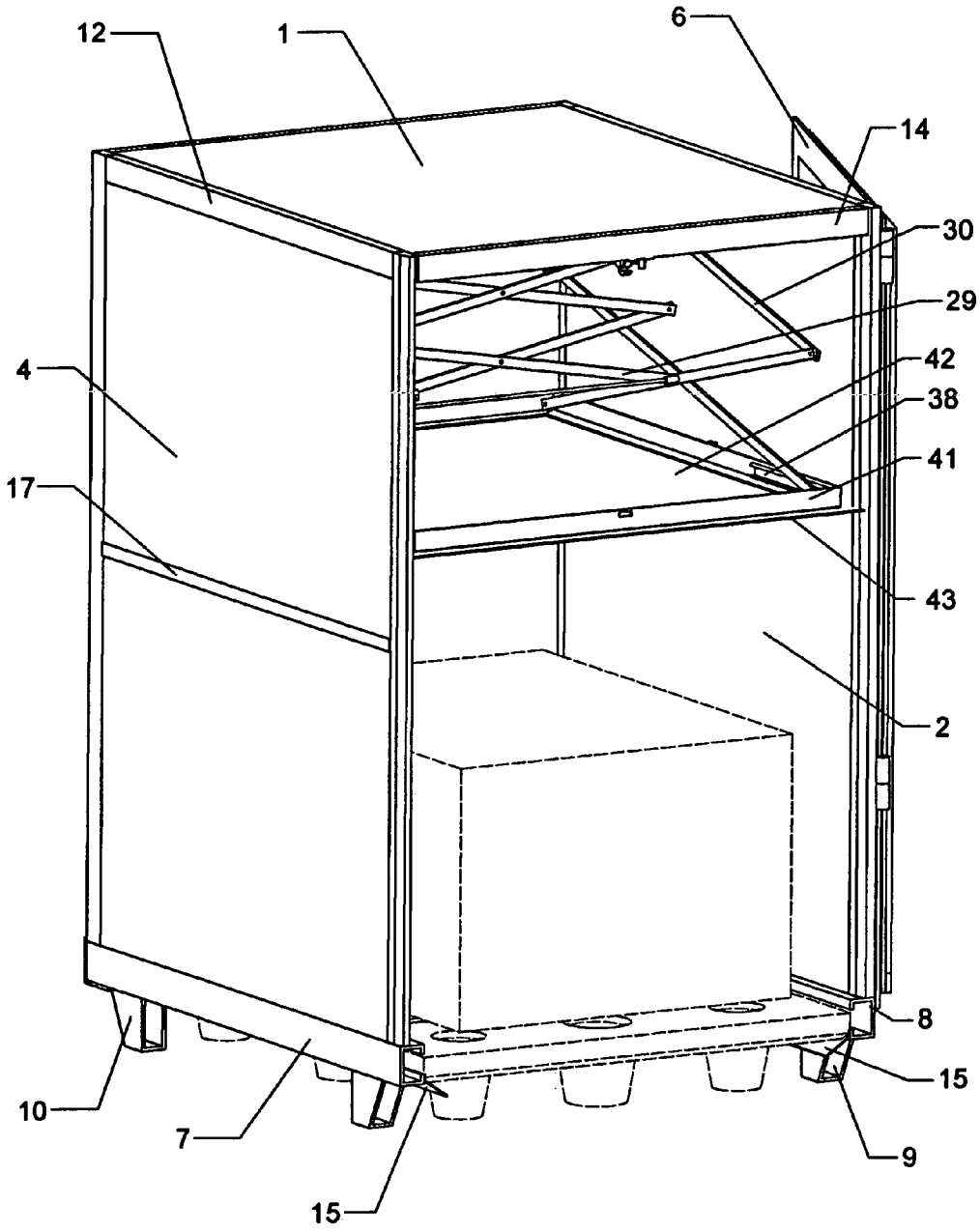
FIG. 2 is a perspective left side view of the cage for frozen foods showing the reducer of cold room raised above the frozen foods resting on the pallet engaged inside the cage.
Figure 3:
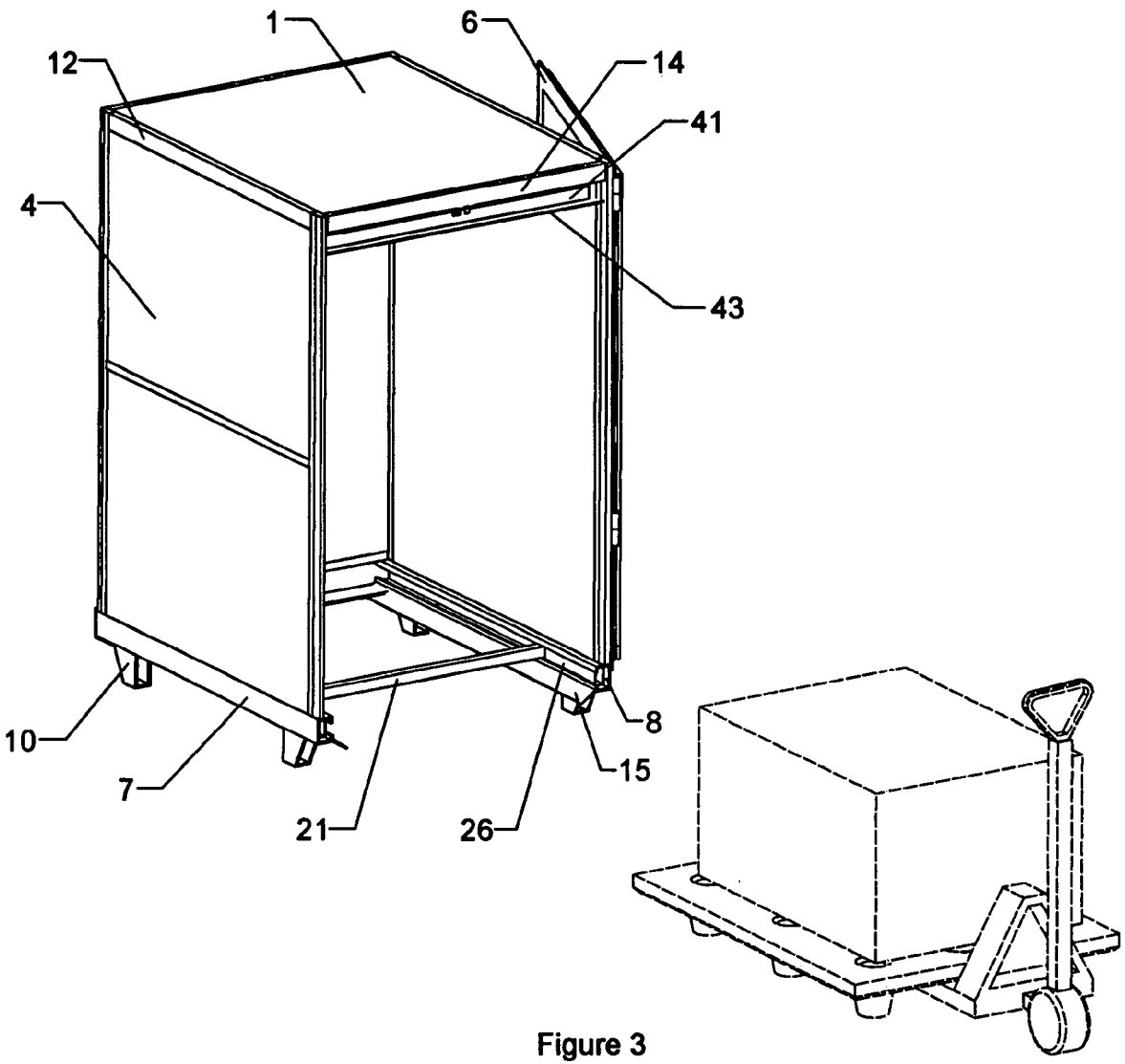
FIG. 3 is a perspective left side view of the cage for frozen foods showing the reducer of cold room in position for blocking, and the frozen foods resting on the pallet transported by a pallet truck.
Figure 4:
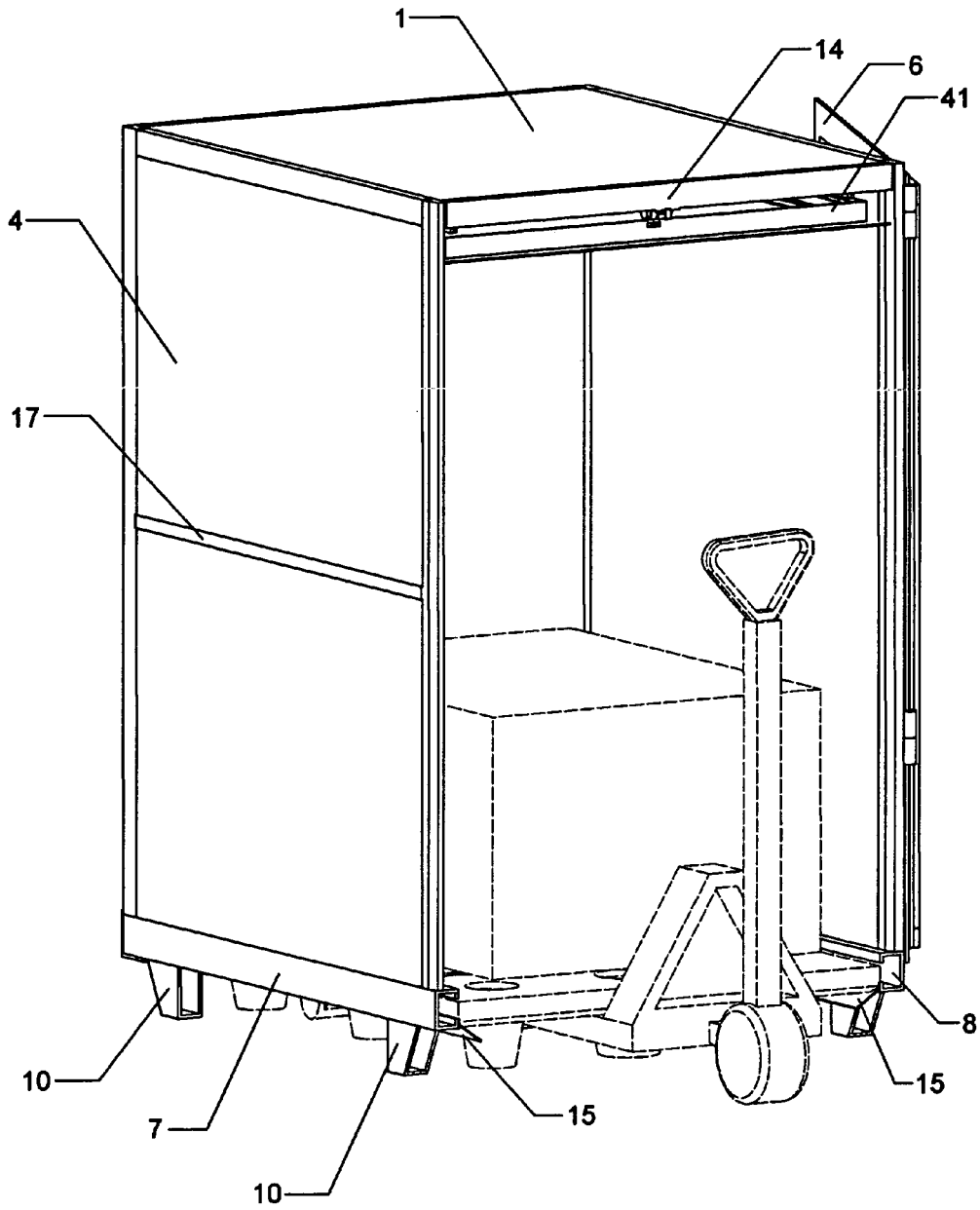
FIG. 4 is a perspective left side view of the cage for frozen foods showing the reducer of cold room in position for blocking and the frozen foods resting on the pallet transported by a pallet truck inside the cage.
Figure 5:
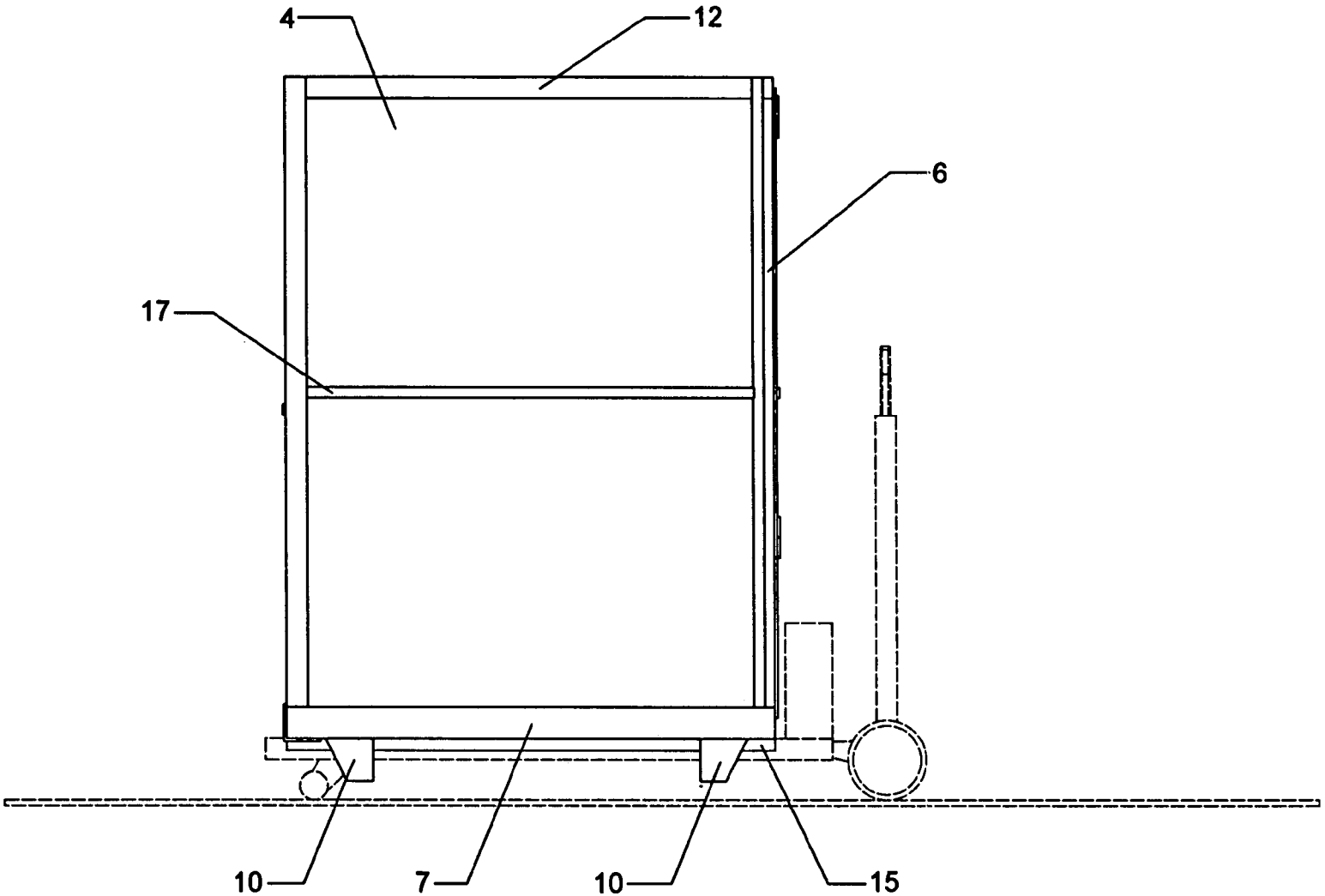
FIG. 5 is a left side view of the cage including the pallet on which resting the frozen foods) and which is transported by the pallet truck.
Figure 6:
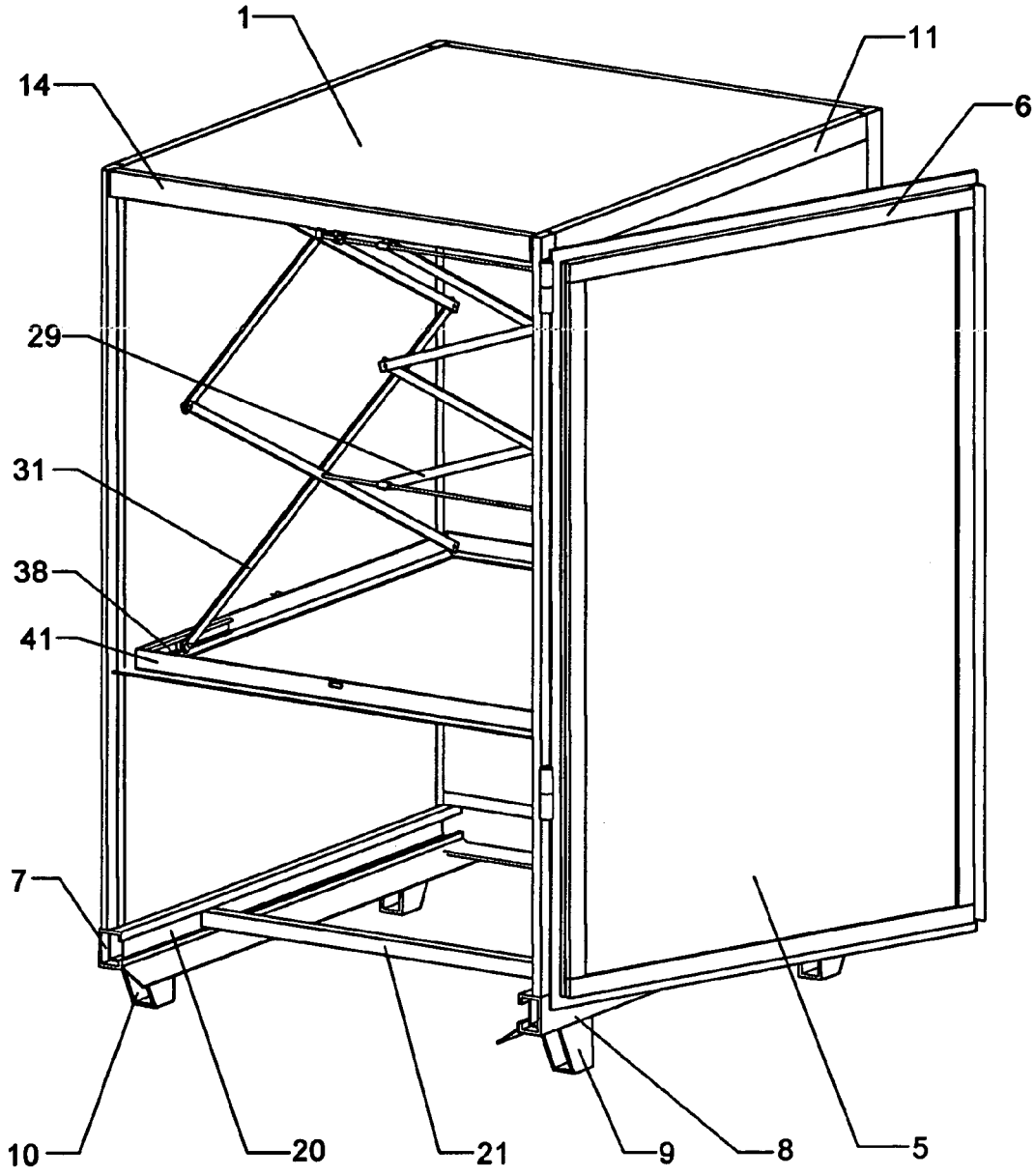
FIG. 6 is a perspective right side view of the cage for frozen foods showing the reducer of cold room lowered inside of the cage, and the reinforcing sliding bar on ball is advanced in front of the structure when the pallet is withdrawn from the cage.
Figure 7:
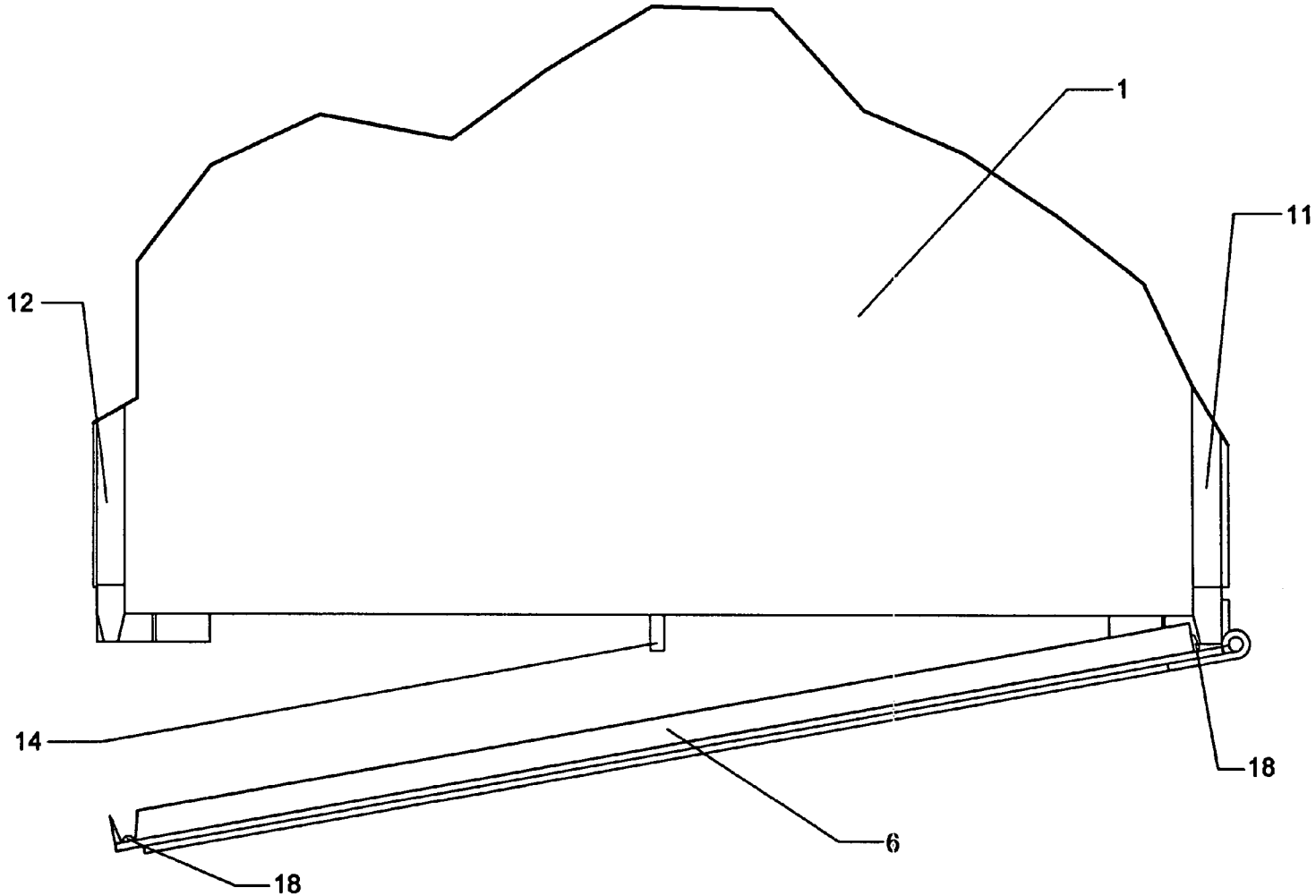
FIG. 7 is a top view of the cage, door and blocking system of the reducer of cold room.
Figure 8:
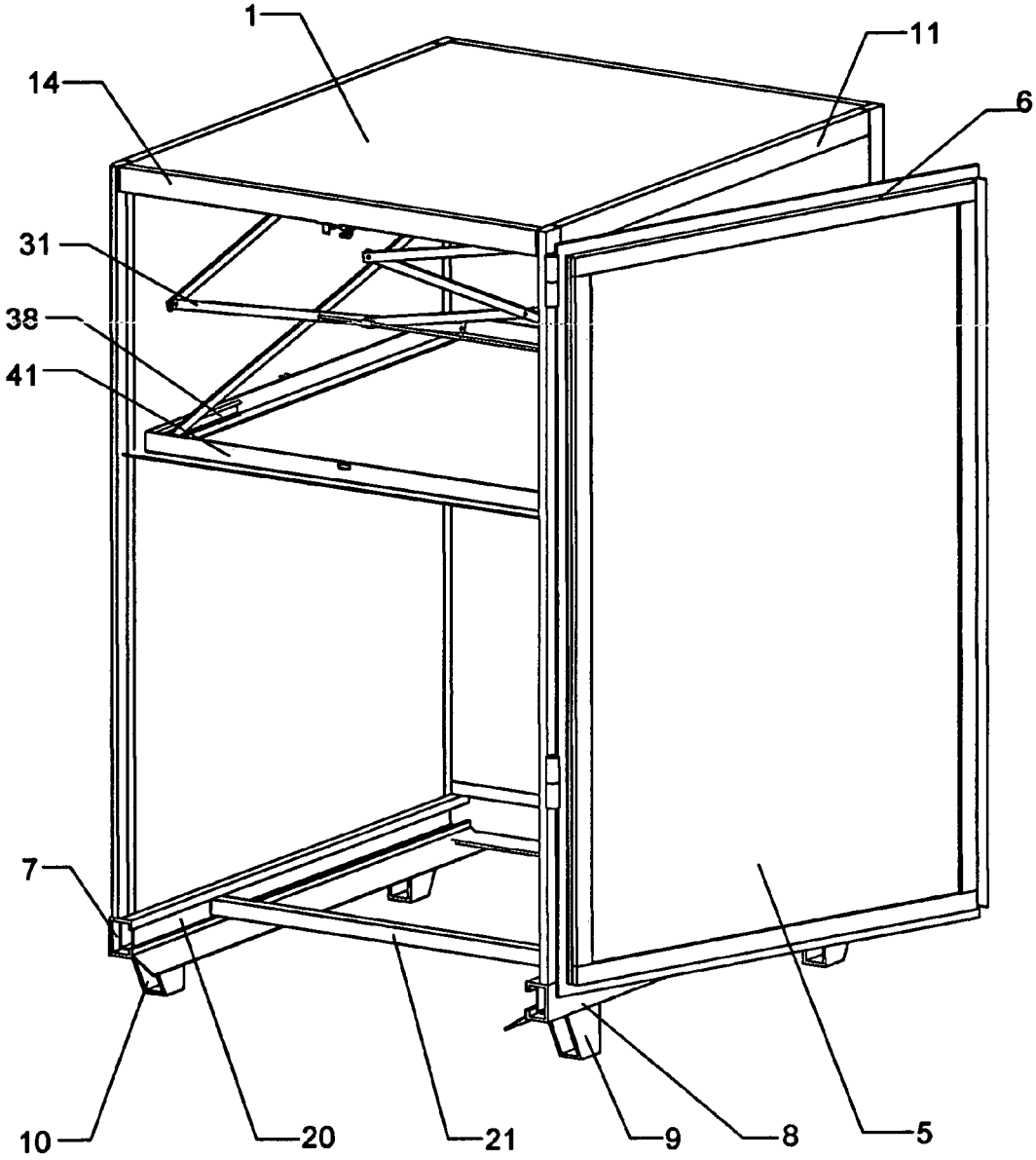
FIG. 8 is a perspective right side view of the cage for frozen foods showing the reducer of cold room raised inside the cage, and the reinforcing sliding bar on ball is advanced in front of the structure when the pallet is withdrawn from the cage.
Figure 9:
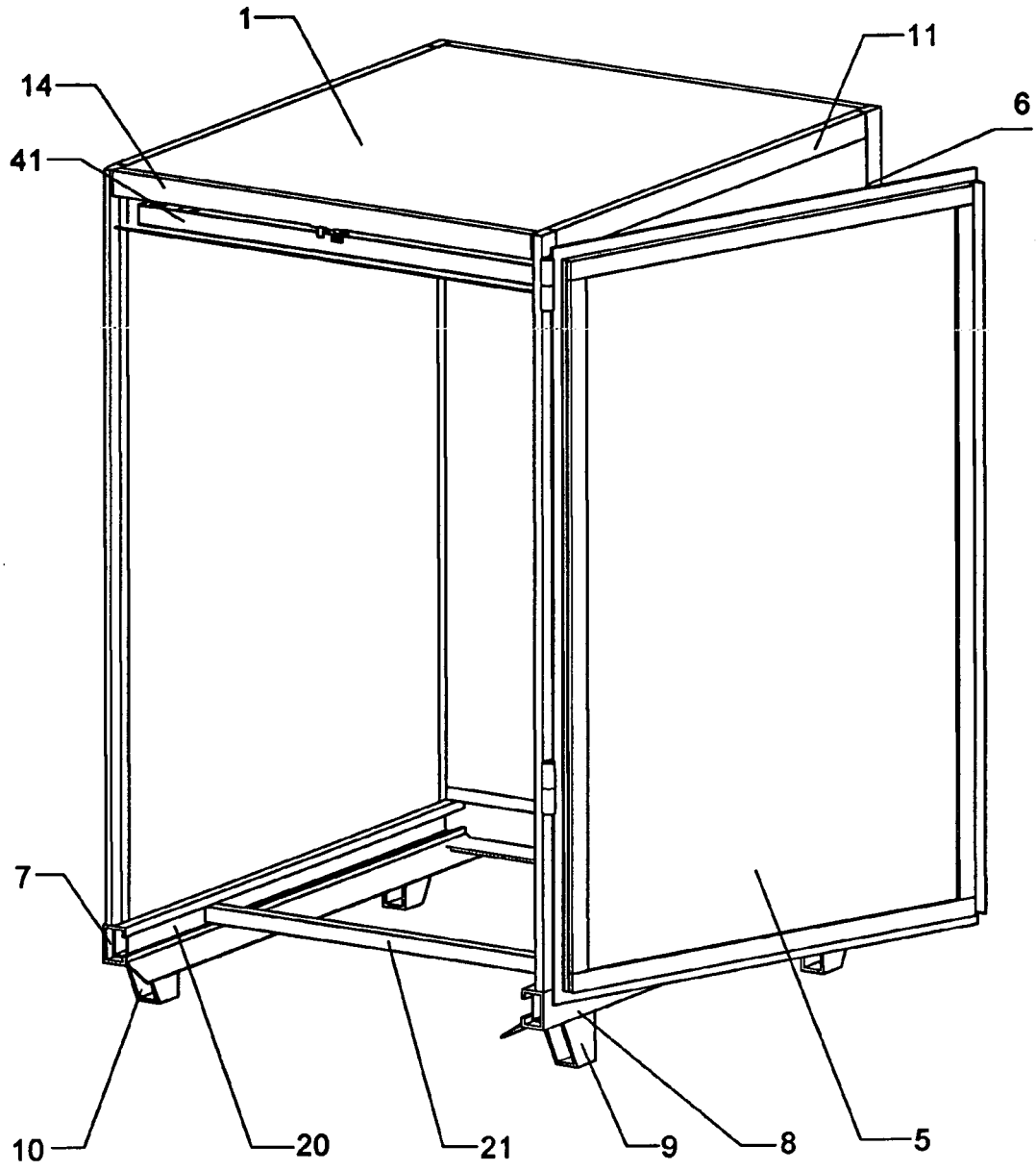
FIG. 9 is a perspective right side view of the cage for frozen foods showing the reducer of cold room in position for blocking.
Figure 10:
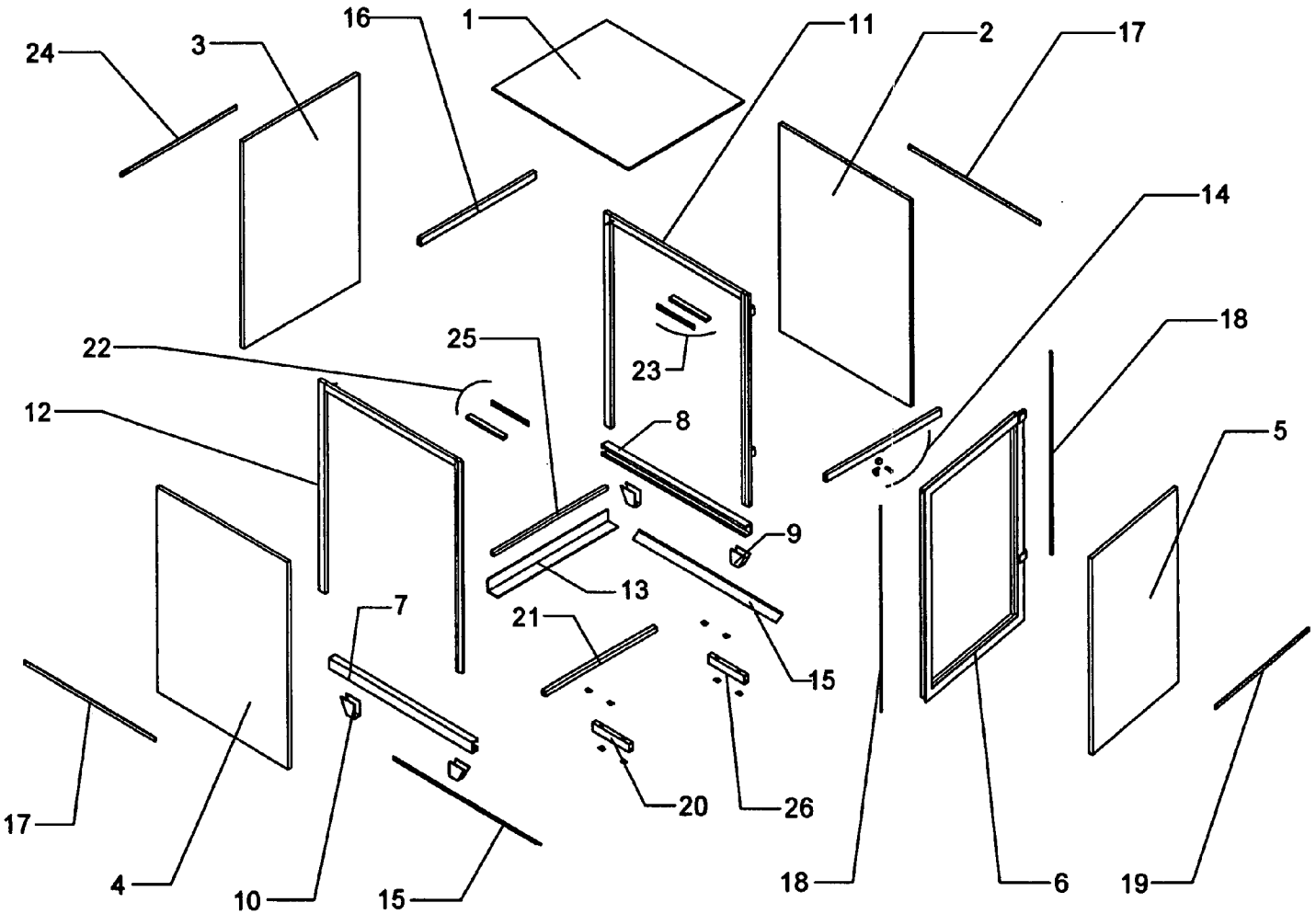
FIG. 10 is an exploded view of the cage for frozen foods.

Cage (A)
Reducer of cold room (B)
Panels (1)(2)(3)(4)(5)
Structure (6) of the door
Tubular Members (7)(8)(11)(12)(14)(16)(25)(27)(28)(34)(35)(37)(40)(41)
Legs (9)(10)
Angle Iron (13)
Weather strip (15)(18)
Reinforcing bars (17)(19)(24)
Members with slide rail (20)(22)(23)(26)(36)(38)
Reinforcing sliding bar on ball (21)
Accordion members (29)(30)(31)
Transverse Bars (32)(33)
Casters (39)
Vapor barrier (42)
Rubber foam (43)
Rigid sheet (44)

DETAILED DESCRIPTION OF THE INVENTION

Now referring to the drawing, and in particular to FIGS. 1 to 12, a reducer of cold room (B) according to the illustrated mode of realization preferred of the invention is intended to be used for reducing the space preserving the frozen foods either by using the ice bags or dry ice during the delivery of the frozen foods.

Referring mainly to FIGS. 1 to 10, it is shown a cage (A) in which is mounted the reducer (B), and which includes an insulating panel (1) that is engaged inside each tubular member (11)(12)(14)(16), and which the tubular member (14) is provided with a hook that allows the reducer of cold room mounted inside the cage to be manually blocked when the hook is engaged in an opening formed therethrough a tubular member (41) which is connected to each tubular member (37) and to a tubular member (40) for receiving a vapor barrier (42), a rubber foam (43) and a rigid sheet (44). An insulating panel (4) which is engaged inside each tubular member (7)(12) and between each tubular member mounted of each side, which a pair of legs (10) is mounted under the tubular member (7) including a member with slide rail (20), which a weather strip (15) is mounted between the member with slide rail (20) and the tubular member (7), and which a reinforcing bar (17) is mounted in the center of the insulating panel (4) for solidifying the structure of the cage. An insulating panel (3) which is engaged inside each tubular member (16)(25) and between each tubular member mounted of each side, which the tubular member (25) includes an angle iron (13) for receiving a reinforcing sliding bar on ball (21) being engaged to each member with slide rail (20)(26) receiving a pallet on which resting the frozen foods, and when the pallet is withdrawn from the cage, the reinforcing sliding bar on ball (21) allows to solidify the front structure of the cage, and which a reinforcing bar (24) is mounted in the center of the insulating panel (3) for solidifying the structure of the cage. An insulating panel (2) which is engaged inside each tubular member (11)(8) and between each tubular member mounted of each side, which a pair of legs (9) is mounted under the tubular member (8) including a member with slide rail (26), which a weather strip (15) is mounted between the member with slide rail (26) and the tubular member (8), and which a reinforcing bar (17) is mounted in the center of the insulating panel (2) for solidifying the structure of the cage. A tubular member in which is engaged the insulating panel (2), is provided with two hinges for connecting a structure (6) in which is engaged an insulating panel (5), and which a reinforcing bar (19) is mounted in the center of the insulating panel (5) for solidifying the structure (6) of the door being provided with a weather strip (18).

The reducer of cold room (B) being formed with a plurality of accordion members (29)(30)(31), which a first accordion member (30) is connected to a tubular member (11) and to a member with slide rail (23) mounted to the tubular member (11), and which the accordion member (30) is also connected to a tubular member (37) mounted to each tubular member (40)(41) of the framework from the reducer (B) and to a member with slide rail (38) mounted to the tubular member (37).

A second accordion member (31) is connected to a tubular member (12) and to a member with slide rail (22) mounted to the tubular member (12), and which the accordion member (31) is also connected to a tubular member (37) mounted to the tubular members (40)(41) and to a member with slide rail (38) mounted to the tubular member (37).

Figure 12:
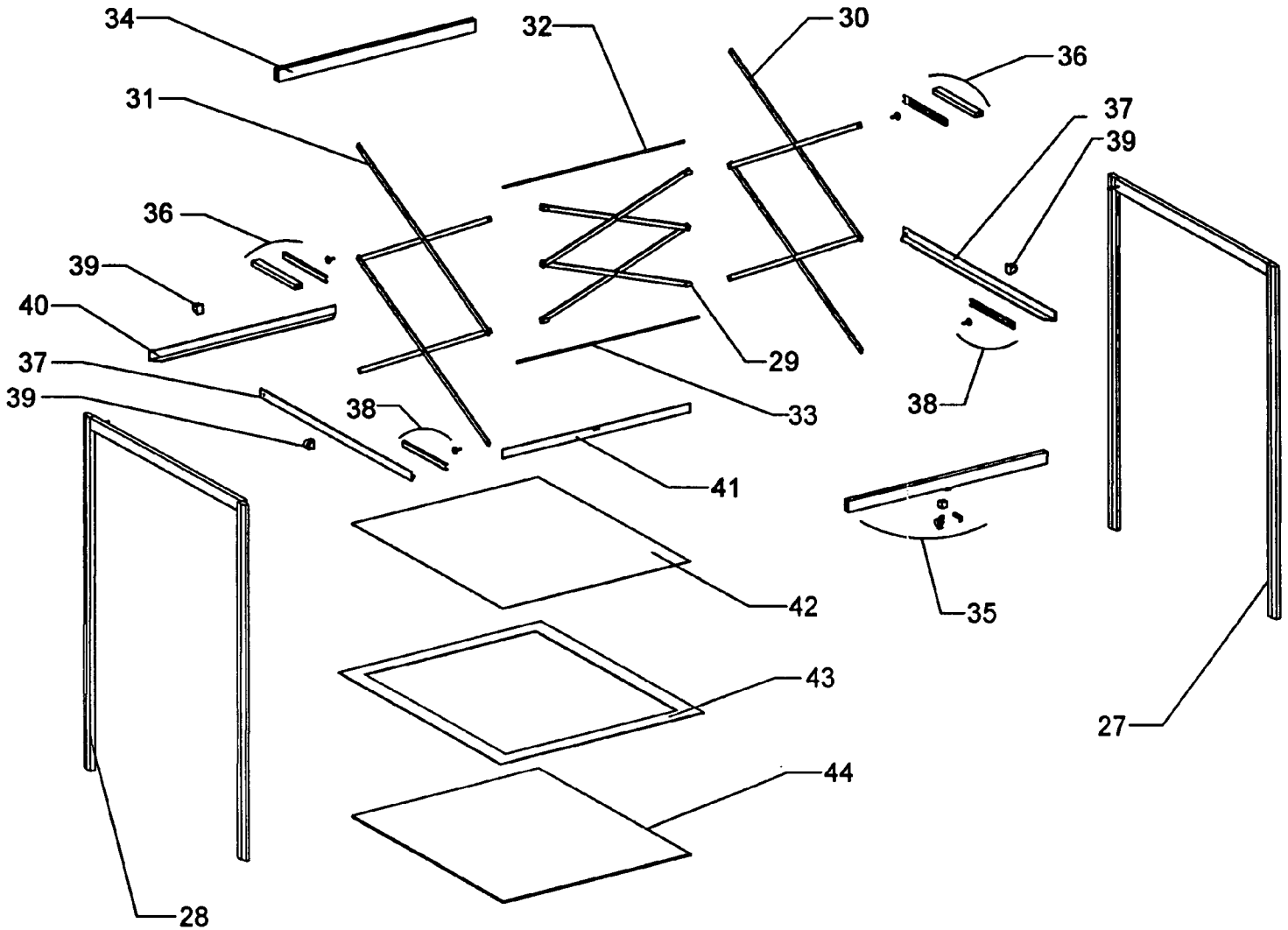
FIG. 12 is an exploded view of the reducer of cold room.

A third accordion member (29) is mounted to the both accordion members (30)(31) thereby two transverse bars (32)(33) being connected by bolts and nuts as illustrated in FIG. 12.

A caster (39) is mounted to each tubular member (37) and (40) to allow the reducer to automatically slope down in straight line and above the frozen foods when the door is closed, and to be manually raised during the loading or unloading of the frozen foods.

Figure 11:
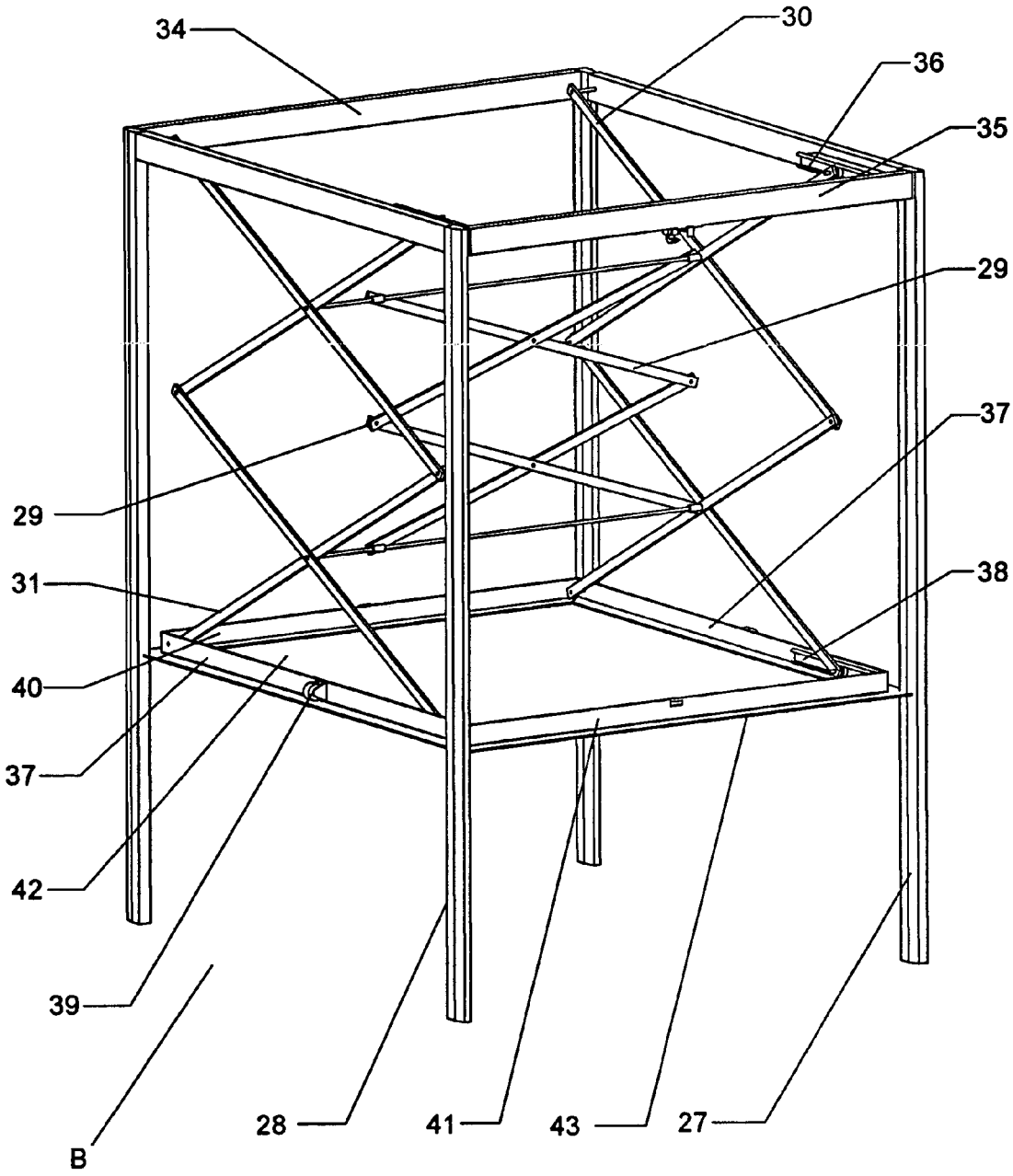
FIG. 11 is a perspective view of the reducer of cold room mounted inside another structure which can be installed inside an existing cage for frozen foods (not shown).

As shown in FIG. 11, the reducer of cold room (B) is mounted inside another structure which is adapted in an existing cage for frozen foods (not shown), which includes two frame members (27)(28) connecting each tubular member (34)(35), and which a member with slide rail (36) is mounted to each frame member (27)(28).

The reducer (B) includes the accordion members (30)(31) which are connected to the tubular fame members (27)(28) and to the members with slide rail (36) mounted to the frame members (27)(28), and which are also connected to the tubular members (37) and to the members with slide rail (38) mounted to the tubular members (37).

The accordion members (30)(31) are mounted to an accordion member (29) by each transverse bar (32)(33) being connected by bolts and nuts.

The tubular members (37) are mounted to the tubular members (40)(41) for receiving a vapor barrier (42), a rubber foam (43) and a rigid sheet (44).

A caster (39) is mounted to each tubular member (37) and (40) to allow the reducer to slope down in straight line and above the frozen foods when the door is closed, and to be manually raised during the loading or unloading of the frozen foods.

Although only a single embodiment of the present invention has been described and illustrated, the present invention is not limited to the features of this embodiment, but includes all variations and modifications within the scope of claims.

The embodiments of the invention for which an exclusive property or privilege is claimed, are defined as follows:

1. A cage in which is mounted a reducer of cold room, said cage including:

a plurality of tubular members for receiving each insulating panel, wherein a lower tubular member includes an angle iron for receiving a reinforcing sliding bar on ball being engaged to two lower members with slide rail, wherein said reinforcing sliding bar allows to solidify the front structure of the cage when the pallet is withdrawn from the cage;

a tubular member having a hook allowing the reducer mounted inside the cage to be manually blocked when the hook is engaged in an opening formed therethrough a tubular member;

a reinforcing bar mounted in the center of each said insulating panel for solidifying the structure of the cage;

a pair of legs mounted under each lower tubular member located in bottom of the cage;

a weather strip mounted between each said lower tubular member and member with slide rail located in bottom of the cage;

a pair of hinges mounted to a tubular member for connecting a structure in which is engaged an insulating panel;

a weather strip mounted to the structure of the door.

2. A reducer of cold room according to claim 1, said reducer including:

two accordion members which are connected in top of the cage and to a framework receiving a vapor barrier, a rubber foam and a rigid sheet, wherein said framework includes a plurality of tubular members having a caster to allow the reducer to slope down in straight line and above the frozen foods when the door is closed, and to be manually raised during the loading or unloading of the frozen foods;

a third accordion member is mounted to said accordion members thereby two transverse bars being connected by bolts and nuts.

3. The reducer of cold room according to claim 2, is also mounted inside another structure which is adapted in an existing cage for frozen foods.

* * * * *